US006926185B2

(12) United States Patent
Svensson

(10) Patent No.: US 6,926,185 B2
(45) Date of Patent: Aug. 9, 2005

(54) WORKING STATION

(75) Inventor: Ake Svensson, Falkenberg (SE)

(73) Assignee: Randek Maskin AB, Falkenberg (SE)

( * ) Notice: Subject to any disclaimer, the term of this patent is extended or adjusted under 35 U.S.C. 154(b) by 0 days.

(21) Appl. No.: 10/450,510

(22) PCT Filed: Dec. 14, 2001

(86) PCT No.: PCT/SE01/02790

§ 371 (c)(1),
(2), (4) Date: Dec. 10, 2003

(87) PCT Pub. No.: WO02/49816

PCT Pub. Date: Jun. 27, 2002

(65) Prior Publication Data

US 2004/0089695 A1 May 13, 2004

(30) Foreign Application Priority Data

Dec. 15, 2000 (SE) ..... 0004654

(51) Int. Cl.[7] ..... B27F 7/00

(52) U.S. Cl. ..... 227/39; 227/2; 227/7; 227/100; 227/110

(58) Field of Search ..... 227/2, 4, 7, 39, 227/44, 45, 99, 100, 109, 119, 110, 142, 154; 29/772, 429, 432

(56) References Cited

U.S. PATENT DOCUMENTS

| | | | | | |
|---|---|---|---|---|---|
| 4,054,236 | A | * | 10/1977 | Paxton | 227/45 |
| 4,403,388 | A | * | 9/1983 | Belcher | 29/429 |
| 4,708,276 | A | * | 11/1987 | Knoth et al. | 227/7 |
| 4,793,540 | A | * | 12/1988 | Mangan et al. | 227/7 |
| 5,058,795 | A | * | 10/1991 | Tonus | 227/7 |
| 5,249,352 | A | * | 10/1993 | Landers | 29/432 |
| 5,312,022 | A | * | 5/1994 | Thompson et al. | 227/130 |
| 5,346,113 | A | * | 9/1994 | Cosden | 227/110 |
| 5,555,617 | A | * | 9/1996 | Pope | 29/772 |
| 6,550,659 | B1 | * | 4/2003 | Kortman et al. | 227/44 |

* cited by examiner

*Primary Examiner*—Scott A. Smith
(74) *Attorney, Agent, or Firm*—McGinn & Gibb, PLLC

(57) ABSTRACT

A device for executing a number of actions, such as driving in nails, on a planar section, for example a wall element, for fixing a covering panel or the like on the planar section. A carriage is displaceable longitudinally over the planar section. A number of the action device are mounted on one side of a carriage and are displaceable individually transversely of the planar section. A number of the action devices are mounted on the other side of the carriage and are displaceable together with one another transversely of the planar section.

12 Claims, 9 Drawing Sheets

18
9
10
30
31
17
16
32
28
11
21
22
23
24
12

7
H
19
18
8
17
H
16
13

30
K
29
B
I
15
18

WORKING STATION

BACKGROUND OF THE INVENTION

Prior art devices of the type disclosed have a complicated design and construction which has a severe effect on the possibility of utilising the device in modern contexts which have high requirements of versatility and, above, all rapidity. A further drawback resides in the fact that prior art constructions require extensive maintenance and, as a result, lengthy down times.

The tasks forming the basis of the present invention are to provide an improved device and to obviate or at least reduce the above-outlined drawbacks.

SUMMARY OF THE INVENTION

The present invention provides a device displaying an extremely high degree of versatility and simple construction. The device according to the present invention makes for the execution of a considerable number of work or action phases with a high degree of rapidity in that, among other things, the requisite displacement distances and displacement phases become considerably shorter than in prior art devices.

BRIEF DESCRIPTION OF THE DRAWINGS

One embodiment of a device according to the present invention will be described in greater detail hereinbelow, with reference to the accompanying drawings.

DETAILED DESCRIPTION

Figure 1:
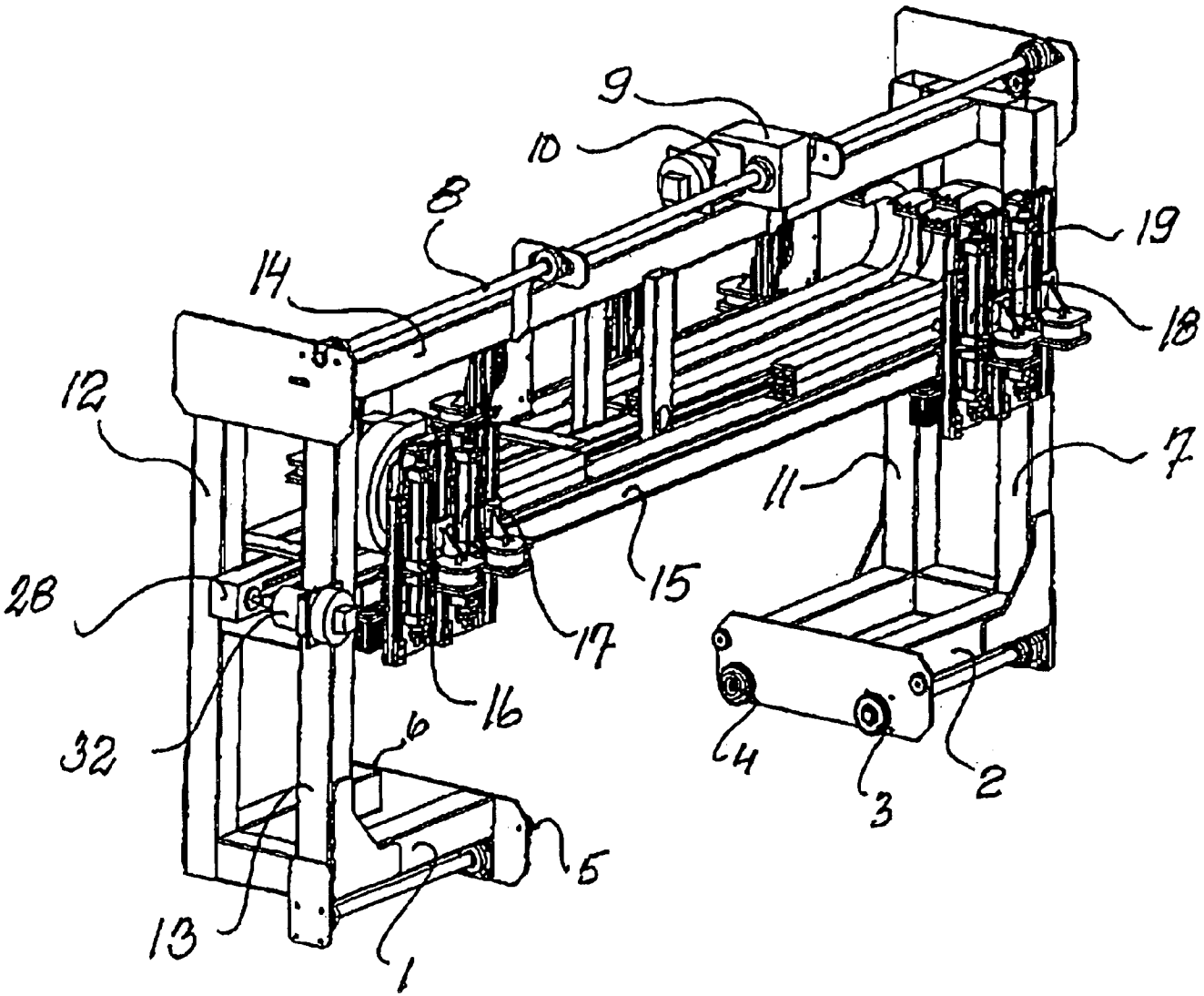
FIG. 1 is a perspective view of one embodiment of a device according to the present invention.
Figure 2:
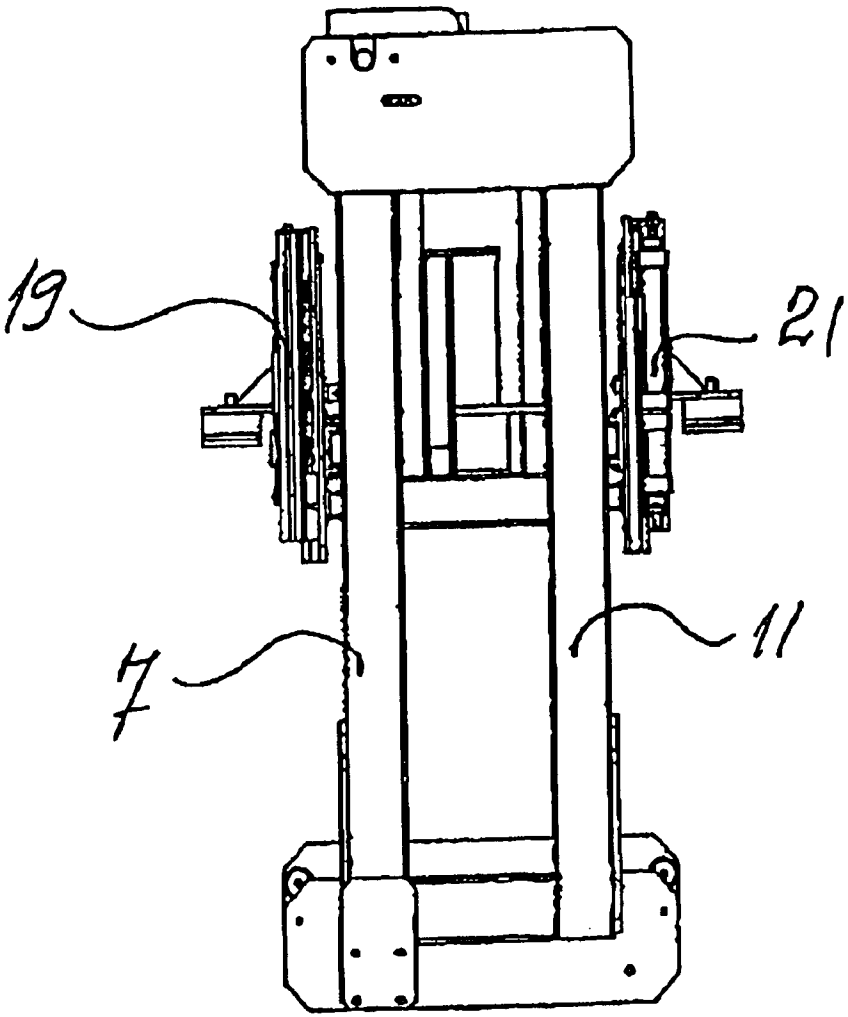
FIG. 2 is a side elevation of the device of FIG. 1.
Figure 3:
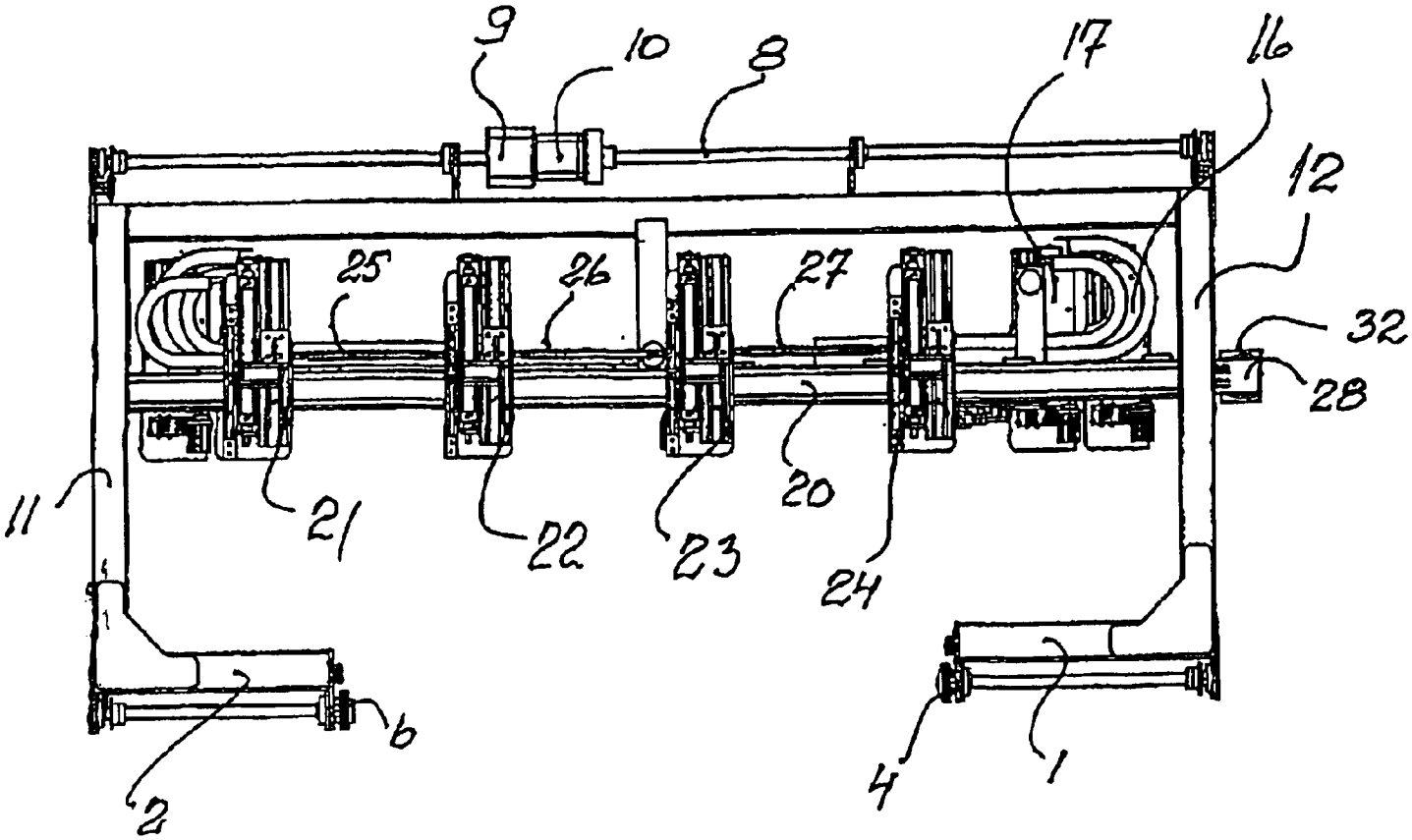
FIG. 3 is a front elevation of the device of FIGS. 1 and 2.
Figure 4:
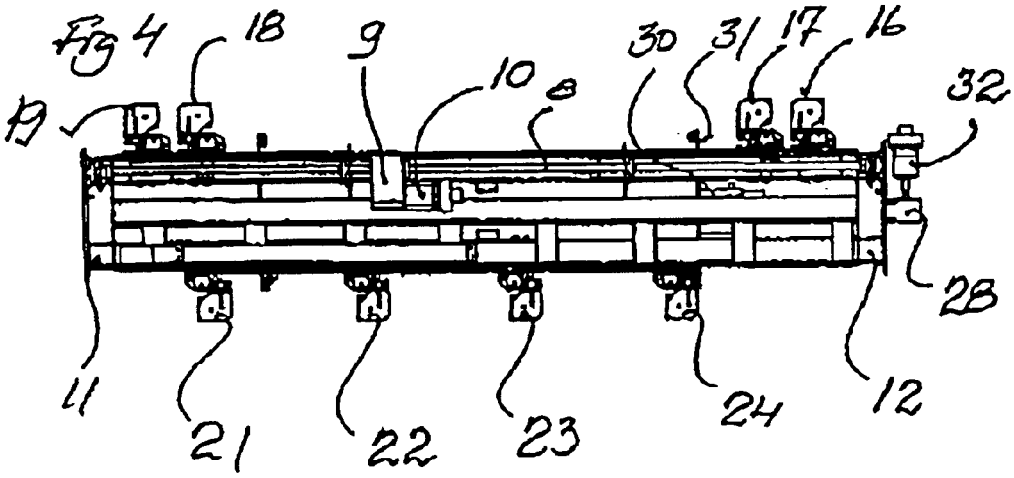
FIG. 4 shows, on a slightly smaller scale, a top plan view of the device of FIGS. 1–3.
Figure 5:
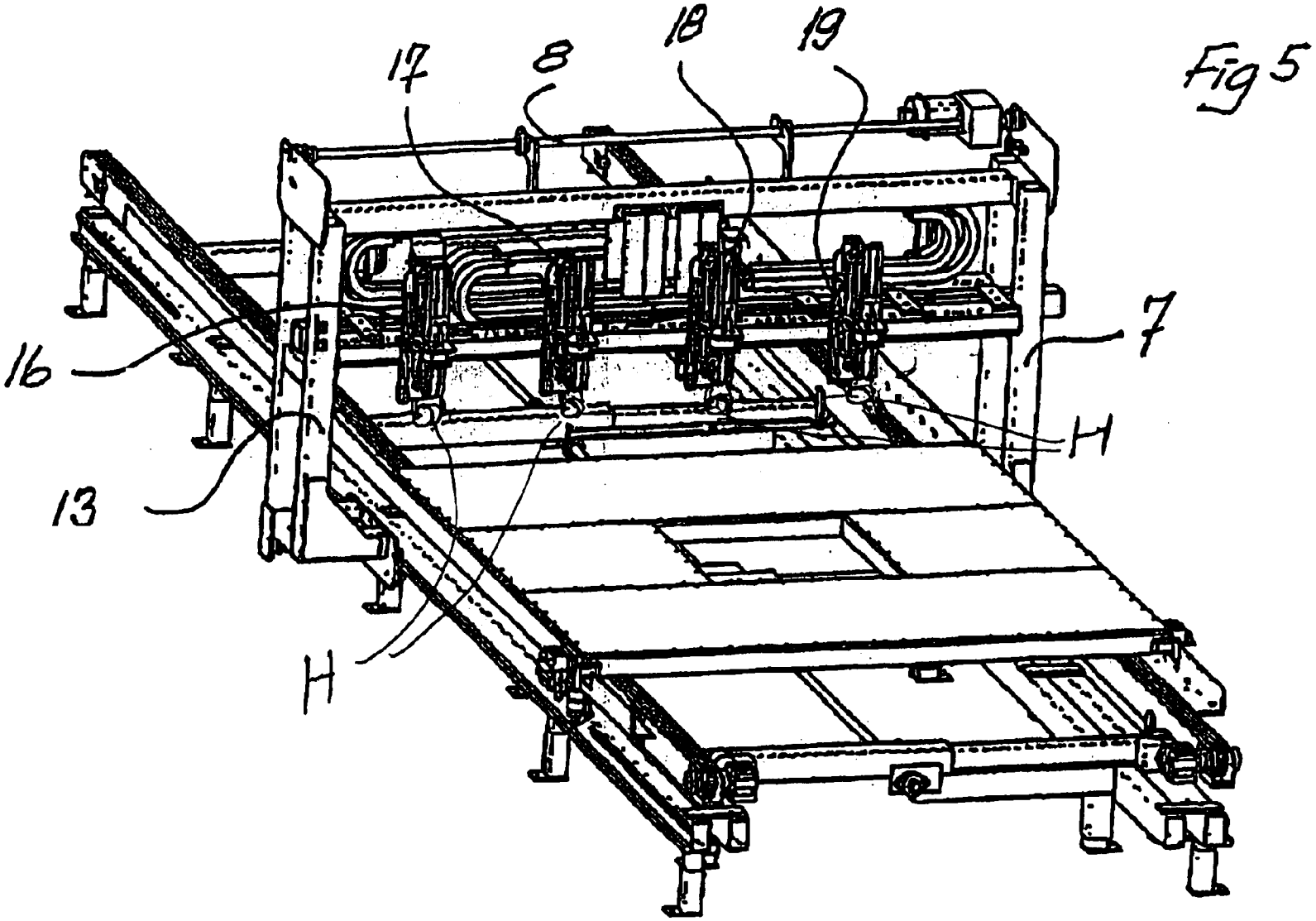
FIG. 5 is a perspective view of an exemplary device according to the present invention for processing of a wall element.
Figure 6:
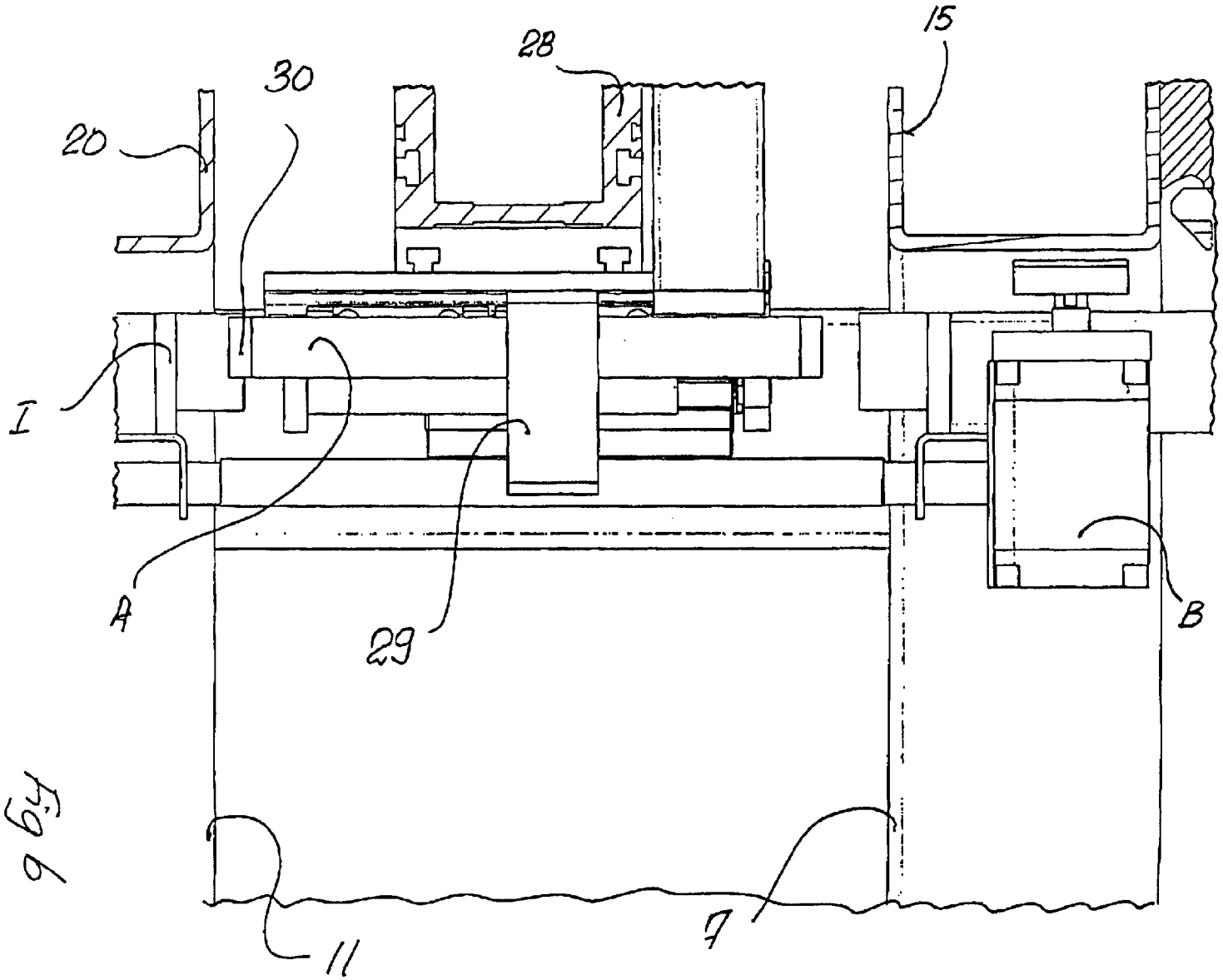
FIG. 6 is an enlarged fragmentary view of parts of the device in FIG. 5.
Figure 7:
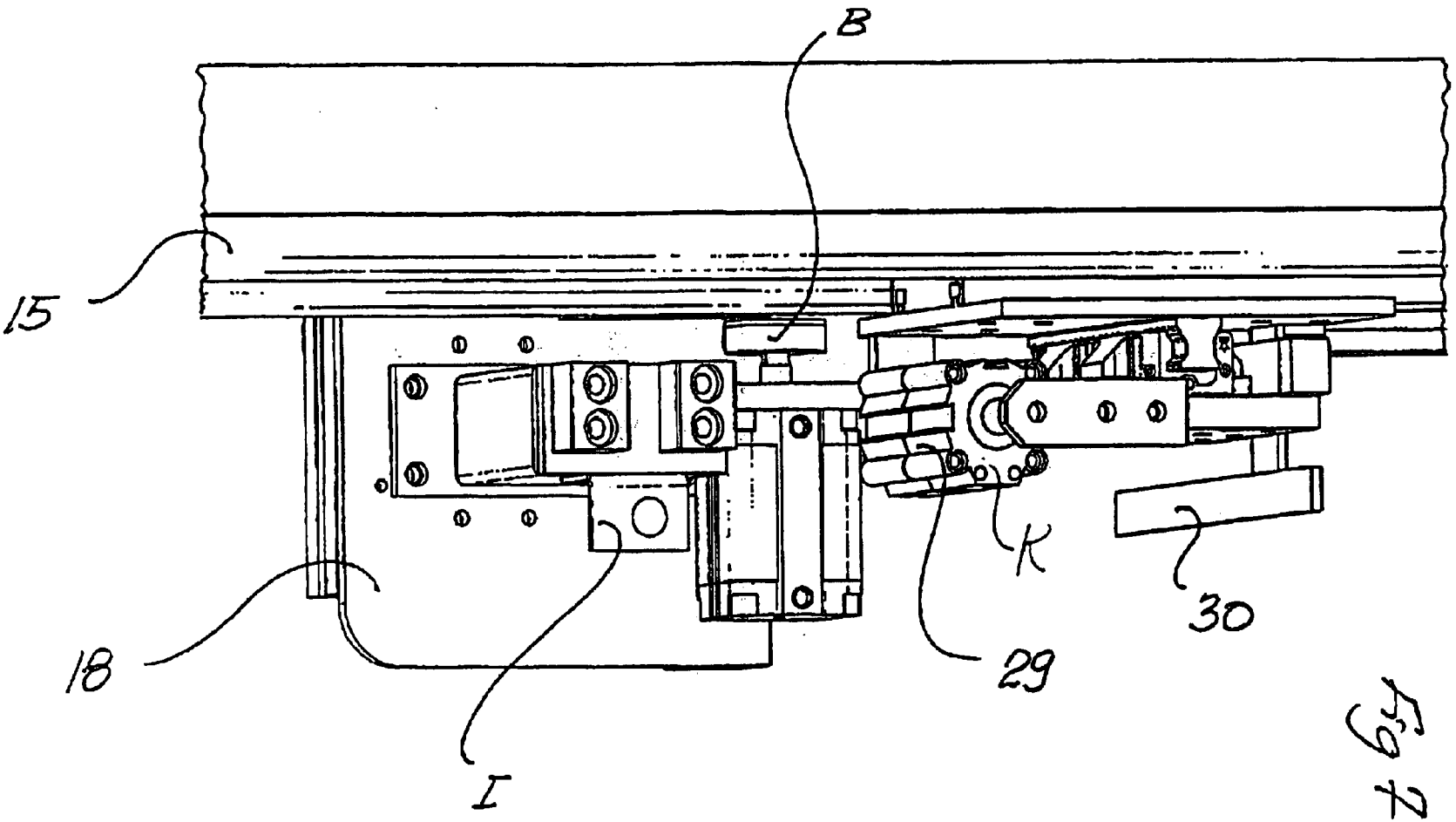
FIG. 7 is a fragmentary view of substantially the same parts as in FIG. 6 taken in another direction.
Figure 8:
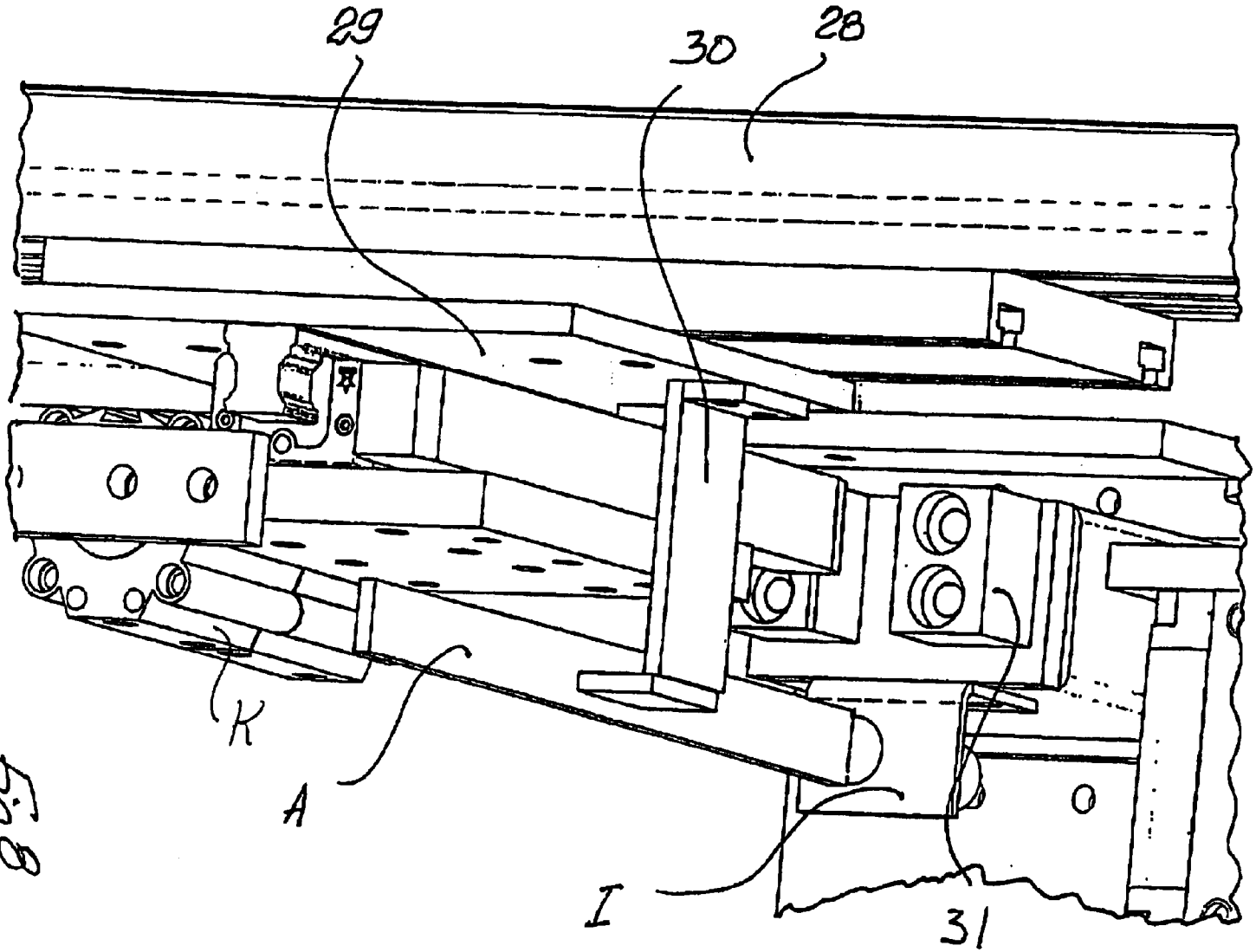
FIG. 8 is a fragmentary view of parts of the device taken in another direction than in FIG. 7.
Figure 9:
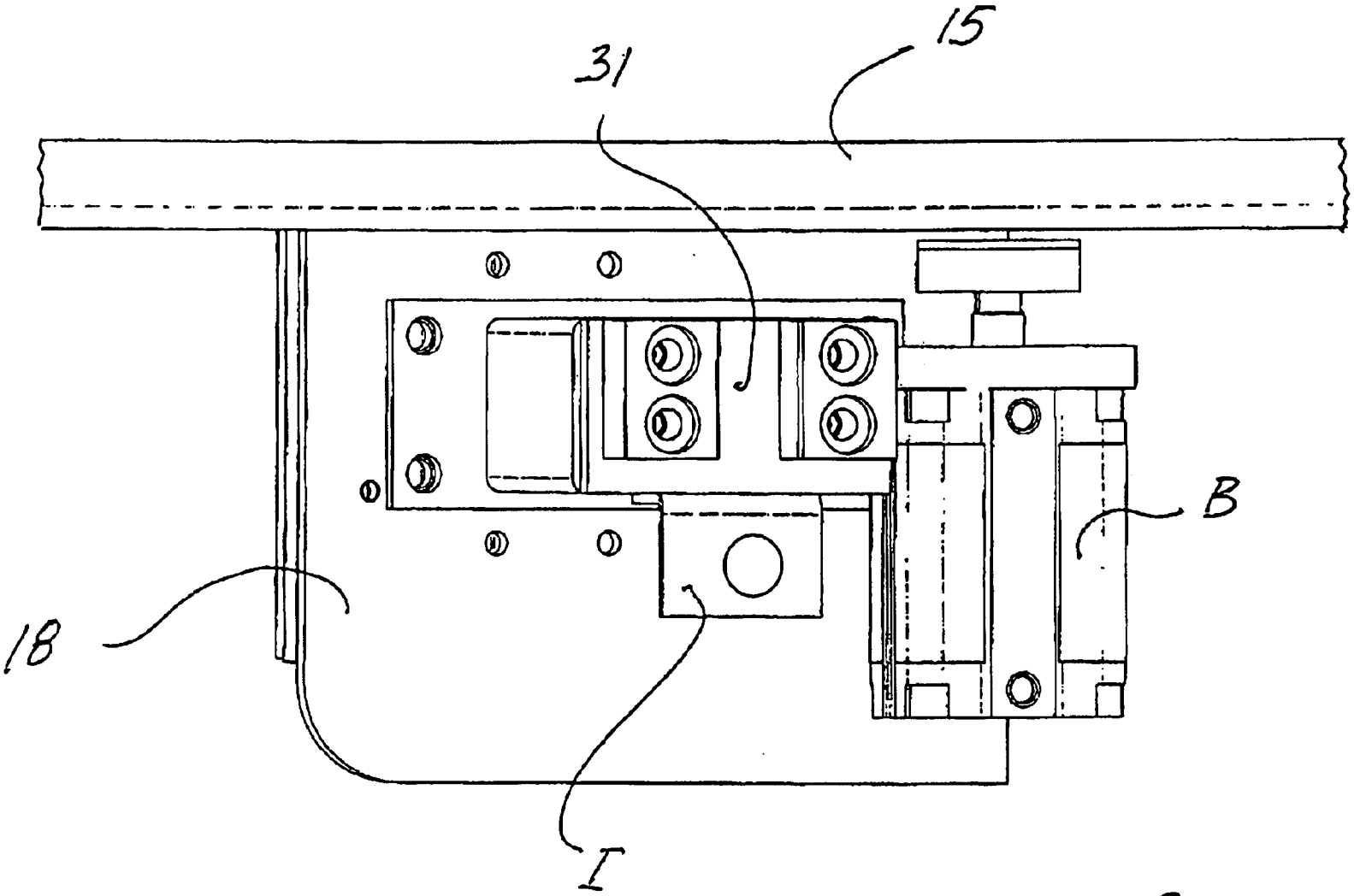
FIG. 9 is a fragmentary view of parts of the device taken in yet another direction.

The embodiment of the present invention illustrated on the drawings will be described in greater detail below in connection with its use for nailing a covering panel, e.g. plywood, on a wall section which consists of a ground plate, a top plate and a number of joists extending therebetween, these parts being nailed together in a different machine. The latticework is placed on a substrate, and the covering panel is placed above the latticework and is to be fixedly nailed thereon for the formation of a wall section as is illustrated in FIG. 5. The latticework or wall section which, in this case, has a door opening and a window opening, is fixed on a substrate which has a runway on either side. The device according to the present invention has, as is shown on the drawings, the form of a gantry with a left foot 1 and a right foot 2. The feet 1 and 2 are provided with wheels 3, 4, 5 and 6, of which a number of wheels are not apparent in FIG. 1.

The wheels 3–6 are intended to run on the runways or rails which extend under the substrate on which the latticework with the covering panel rests and is fixed. A number of the wheels 4–6 are driven for movement of the carriage or gantry along the rails. The wheels 3–6 are driven by means of a chain which extends through one of the legs 7 of the carriage or gantry. The chain extends around a gear chain wheel at the end of a shaft 8 which extends to the opposite end of the carriage or gantry and through a prime mover in the form of a gearbox 9 and a motor 10.

The carriage or gantry has one leg at each comer. In addition to the leg 7, there are thus legs 11, 12 and 13. The legs 7, 11, 12 and 13 carry a crosspiece or beam 14 which interconnects the legs 7, 11, 12 and 13 with each other and supports the drive means 9, 10 and the shaft 8.

A beam 15 extends between the legs 7 and 13 and carries four nail guns 16, 17, 18, 19. The nail guns 16–19 are reciprocally movable on the beam 15 both individually and mutually. Between the legs 11 and 12, there is disposed an additional beam 20 for a further four nail guns 21, 22, 23 and 24. The nail guns 21 and 22 are interconnected by means of a rod 25, while the nail guns 22 and 23 are interconnected by means of a rod 26 and the nail guns 23 and 24 are interconnected by means of a rod 27. Thus, the nail guns 21, 22, 23 and 24 are movable on the beam 20 reciprocally thereon in one unit with one another, since they are interconnected with one another by means of the rods 25, 26 and 27. The nail guns 16–19 and 21–24 normally consist of pneumatic nailing units with nail band magazines for the automatic driving of nails. Naturally, there is nothing to prevent the use of screw tightening units instead of the nailing units for fixing the covering panel by means of screws instead of nails. It is also possible to employ both nailing units and screw driving units or other unit combinations.

Centrally within the carriage or the gantry and between the legs 7 and 11 and 12 and 13, there is disposed a further beam 28 for a centrally disposed switching unit or displacement unit 29 which is provided with a connection device 30 which, by means of a piston and cylinder assembly K, is switchable from a free position disengaged from any of the units 16–19 or 21–24 to and from engagement with any of the nailing units 16–19 on the one side of the gantry or the mutually interconnected units 21–24 on the other side of the gantry. Thus, there is required only a single engagement between the connection device 30 and a connection female unit 31 with all of the nailing units 21–24, on the one hand, with the aid of an inductive transducer 1 and an element A co-operating therewith, to find the position of the units and, on the other hand, to displace all units 21–24 to a new position. For switching of the other nailing units 16, 17, 18 and 19, engagement is required with each one of their connection female units 31 and the connection device 30 after switching thereof by means of the piston and cylinder assembly K of the displacement unit 29 and, further, for establishing the position of the unit by means of each one of the units' connection female units 31 and the connection device 30 and also for placing of each respective unit in the desired position.

The switching unit 29 with the connection device 30 and the element A is displaceable on the beam 28 towards and away from the ends of the carriage or gantry by means of a motor 32 which drives a toothed belt inside the beam 28. Naturally, the toothed belt is in engagement with the switching unit 30. The drive motor 32 is mounted on the leg 13.

The nailing units 16–19 and 21–24 are each provided with a brake B, while the nailing units 21–24 are provided with a common brake B. The brakes B are in the form of a cylinder for braking engagement with a braking path on or at each respective beam 15, 20. The nailing units 16–24 are provided with wheels for cooperation with the covering panel. These wheels also serve for providing a substantially uniform nailing depth. It is also possible to carry out many other work phases, e.g. a glue application phase.

Many modifications are Naturally possible without departing from the scope of the inventive concept.

What is claimed is:

1. An apparatus for executing a number of actions on a covering panel positioned on a planar section, said apparatus comprising:

a carriage adapted for movement over the planar section;

a first drive source for moving said carriage over the planar section;

a first plurality of action devices mounted on a first side of said carriage so as to be movable with said carriage over the covering panel when the covering panel is on the planar section;

a second plurality of action devices mounted on a second side of said carriage so as to be movable with said carriage over the covering panel when the covering panel is on the planar section:

a connecting device connecting said second plurality of action devices with one another;

a second drive source for moving said first plurality of action devices on said carriage independently of each other, and for separately moving said second plurality of action devices on said carriage together with one another.

2. The apparatus as claimed in claim 1, wherein said first drive source moves said carriage reciprocally over the planar section in a first direction, and said second drive source moves said action devices reciprocally on the carriage in a second direction, substantially at right angles to the first direction.

3. The apparatus as claimed in claim 1, further comprising a displacement device for controlling movement of said action devices on said carriage.

4. The apparatus as claimed in claim 3, wherein said displacement device comprises a connection unit which is switchable between a first position, in which said connection unit controls movement of said first plurality of action devices, and a second position, in which said connection unit controls movement of said second plurality of action devices.

5. The apparatus as claimed in claim 3, wherein said displacement device is positioned substantially centrally of said carriage, between said first plurality of action devices and said second plurality of action devices.

6. The apparatus as claimed in claim 1, wherein said first plurality of action devices and said second plurality of action devices move with said carriage over the same side of the covering panel when the covering panel is on the planar section.

7. The apparatus as claimed in claim 1, wherein said action devices comprise fastening devices.

8. The apparatus as claimed in claim 7, wherein said fastening devices comprise nail guns.

9. The apparatus of claim 8, further comprising positioning members for assuring that said nail guns are positioned a known distance from the surface of the covering panel when the covering panel is on the planar section so that the nails are driven a uniform depth into the covering panel and the planar section.

10. The apparatus as claimed in claim 9, wherein said positioning members comprise wheels.

11. The apparatus as claimed in claim 7, wherein said fastening devices comprise screw tightening units.

12. The apparatus as claimed in claim 7, wherein said fastening devices comprise glue application units.

* * * * *